United States Patent [19]

Murphy

[11] 4,068,577

[45] Jan. 17, 1978

[54] WORK POSITIONING TABLE

[76] Inventor: Patrick Joseph Murphy, 1324 S. Plaza, Springfield, Mo. 65804

[21] Appl. No.: 667,080

[22] Filed: Mar. 15, 1976

[51] Int. Cl.[2] ..... B30B 15/30

[52] U.S. Cl. ..... 100/224; 108/137; 100/229 R; 280/43.23

[58] Field of Search ..... 280/43.19, 43.14, 43.23, 280/43.24, 43, 43.17; 108/137; 312/250; 72/446; 100/221, 224, 229 R, 215, DIG. 18; 29/251

[56] References Cited

U.S. PATENT DOCUMENTS

| | | | |
|---|---|---|---|
| 179,091 | 6/1876 | Boomer | 100/224 |
| 2,176,543 | 10/1939 | Norton | 100/224 |
| 3,168,034 | 2/1965 | McClocklin | 100/229 |
| 3,368,479 | 2/1968 | Gregorovich | 100/229 |
| 3,371,515 | 3/1968 | Munschauer | 72/446 |

FOREIGN PATENT DOCUMENTS

| | | | |
|---|---|---|---|
| 1,522,855 | 3/1968 | France | 280/43 |

*Primary Examiner*—Billy J. Wilhite

*Attorney, Agent, or Firm*—Gravely, Lieder & Woodruff

[57] ABSTRACT

A work supporting table has a carriage which extends beneath the bed of a press and a table top which extends over the bed. The carriage has wheels which rotate about eccentric spindles on the ends of the two axle shafts. Chains are wrapped around these shafts and forces are applied to the chains by an air cylinder mounted on the carriage. When the chains are drawn taut, the axles rotate such that the spindles move downwardly and cause the wheels to descend with respect to the carriage frame and thereby lift the table upwardly. The wheels when so disposed support the table with its table top slightly above the press bed. Conversely when the chains are released, the wheels move upwardly and the table top descends onto the press bed which supports it so that a force applied to a workpiece on the table top is resisted by the press bed.

10 Claims, 6 Drawing Figures

WORK POSITIONING TABLE

BACKGROUND OF THE INVENTION

This invention relates in general to supporting devices, and more particularly to a work supporting table.

Presses are often employed to apply heavy forces to workpieces, but the presses must be constructed quite large themselves in order to withstand the large forces they apply. As a result the press bed on which the workpiece is usually positioned is quite large and elevated above the surrounding surface area. The press ram and its supporting structure must also be quite large, and all of this structure is generally located directly above the bed.

Due to the disposition of the press ram and its supporting structure directly over the press bed, in most instances, considerable difficulty is encountered maneuvering the workpiece beneath the press ram and onto the elevated bed.

SUMMARY OF THE INVENTION

One of the principal objects of the present invention is to provide a work supporting table which facilitates the positioning of a workpiece between the bed and the ram of a press so that the press ram may apply a force to the workpiece. Another object is to provide a table of the type stated which may be lowered to a position wherein it is supported on the press bed so that the force applied by the press ram is resisted by the press bed and not by the table. A further object is to provide a work supporting table which moves relative to the press so that a workpiece may be loaded upon it and then moves under the press ram with little effort. An additional object is to provide a table of the type stated which is simple in construction and easy to operate.

The present invention is embodied in a table which is capable of moving upwardly and downwardly, primarily so that it may be moved between a supporting and non-supporting position with respect to a press bed. The invention also consists in the parts and in the arrangement and combinations of parts hereinafter described and claimed.

DESCRIPTION OF THE DRAWINGS

In the accompaying drawings which form part of the specification and wherein like numerals and letters refer to like parts wherever they occur.

DETAILED DESCRIPTION

Figure 1:
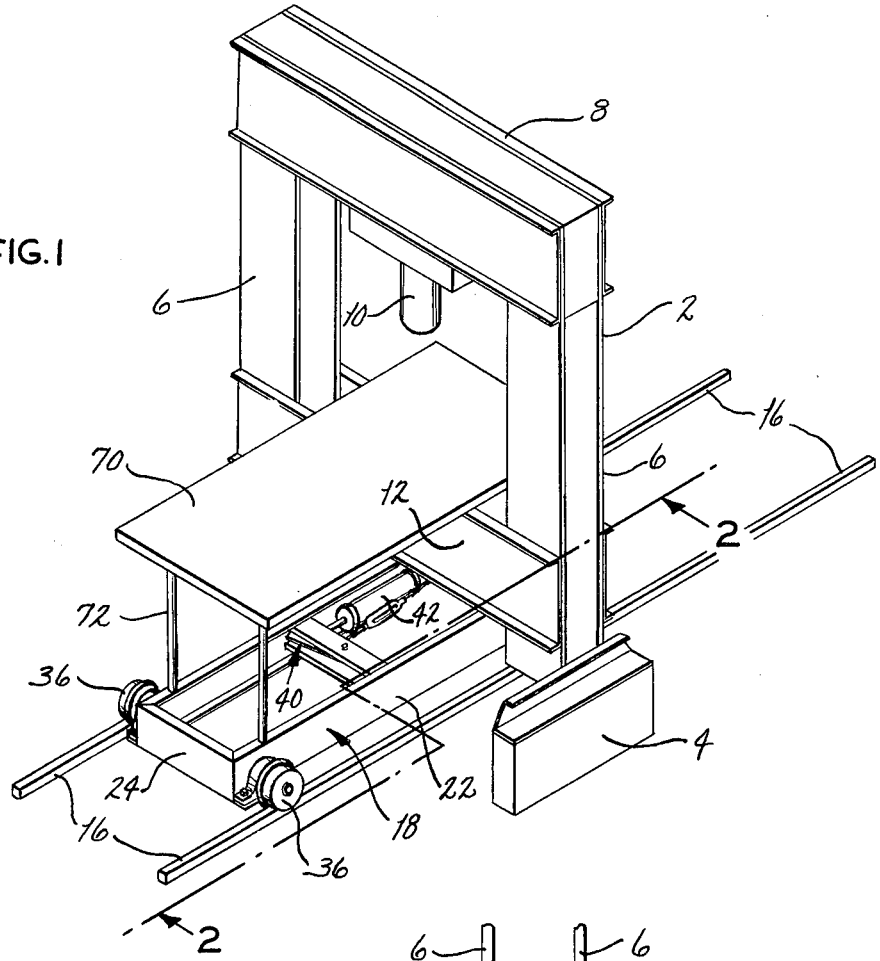
FIG. 1 is a perspective view of the work supporting table of the present invention shown in cojunction with a press.

Referring now to the drawings (FIG. 1), a work supporting table T is used in conjunction with a press P to enable heavy workpieces to be easily positioned in the press P such that the press P may apply a force to the workpiece.

To effect this end, the table T is extended through the press P and is further movable relative to the press P. This enables the workpiece, after being placed on the table T, to be moved with table T to an appropriate position within the press P. When the press P is applying a force against the workpiece, the table T is against the press P and supported thereby. To free the table T from the press P so that the table T may be moved, the table T has the capability of elevating itself with respect to the press P.

The press P is conventional and includes (FIG. 1) a frame 2 having a base 4 which rests upon a floor, a pair of upright members 6 extended upwardly from the base 4, and a cross head 8 supported by the upright members 6 at the upper ends thereof. The cross head 8 in turn supports a ram 10, which may be a hydraulic cylinder, the piston rod of which moves vertically towards and away from the floor. Extended between the upright members 6 in an elevated position above the floor but below cross head 8 and ram 10 is a bed 12, the upper surface of which is both horizontal and planar. The ram 10 is centered with respect to the bed 12 and moves toward and away from the bed 12.

The table T rides on a track 16 which is anchored to the floor on which the press P rests. The track 16 is located between the two upright members 6 of the press and extends beneath the press bed 12.

The table T includes a carriage 18 (FIGS. 2 & 6) having a frame 20 composed of longitudinal members 22 which are connected at their ends by cross members 24. The members 22 and 24 may be steel channels which are mitered at their ends and welded together. The two longitudinal members 22 are further connected midway between the ends by a pair of intermediate cross pieces 26 which are spaced slightly apart in the vertical direction. Near their ends the longitudinal members 22 are provided with outwardly directed flanges 28 which are flush with the underside at the frame 20. The flanges 28 have pillow blocks 30 bolted to them, and the two pillow blocks 30 at each end of the carriage frame 20 are axially aligned. Extended through the aligned pillow blocks 30 at each end of the carriage frame 20 as well as through the longitudinal members 22 which are located inwardly from those pillow blocks 30 are axle shafts 32, and these shafts are capable of rotating within their respective pillow blocks 30.

Figure 2:
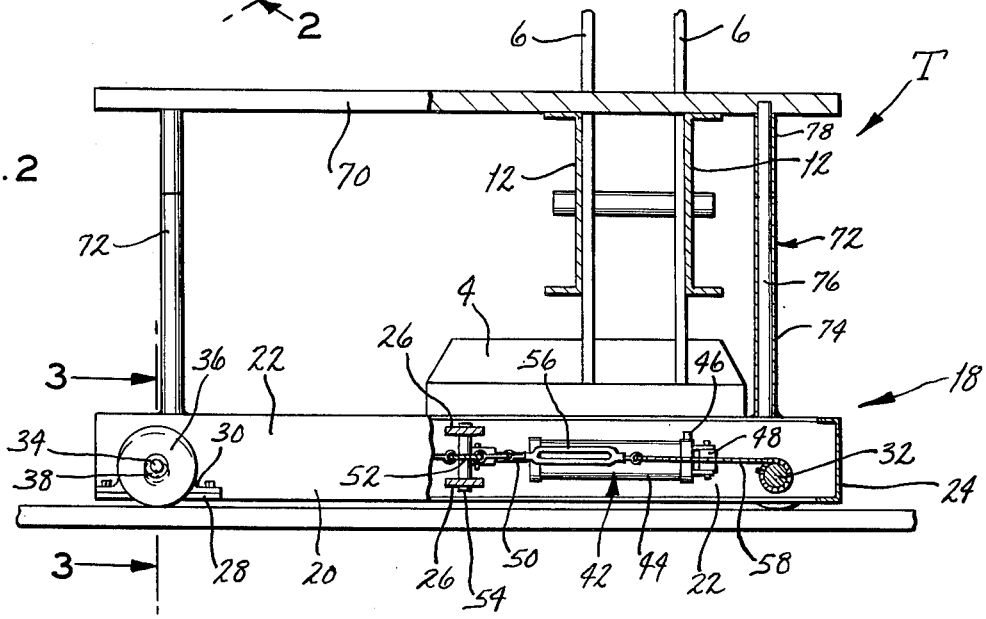
FIG. 2 is a partial sectional view taken along line 2—2 of FIG. 1 and showing the work supporting table in its lower position wherein it is supported on the press bed.

Each shaft 32 at its end is provided with eccentric spindles 34 (FIGS. 2 & 3) which are eccentric in the sense that their axes 34 are offset radially with respect to the axes of the shaft 32, but are nevertheless parallel to the axis of the shaft 32. Moreover, the two spindles 34 of each shaft 32 have their axes aligned so that both are offset in the same direction or at the same angle. The spindles 34 serve as journals for flanged wheels 36 which ride upon the rails of the track 16, each wheel 36 having a bearing 38 which enables it to rotate freely on its spindle 34. The eccentricity of the spindles 34, the locations of the axle shafts 32, and the diameter of the wheels 36 are all such that when the spindles 34 are near their lowermost position the carriage 20 will be supported entirely on the wheels 36 which roll along the track 16, thus enabling the carriage 20 to be moved with relative ease along the track 16 (FIG. 4). In this connection, the bed 12 of the press P is located somewhat higher than the carriage 18 so that the carriage 20 will roll under the bed 12 with adequate clearance. However, when the axle shafts 32 are rotated away from the position, the carriage 18 is lowered (FIG. 2).

The two axle shafts 32 are rotated by an actuating mechanism 40 (FIG. 6), with the rotation being such that the spindles 34 on the two axle shafts 32 are moved between their elevated and depressed positions in unison. The elevating mechanism 40 includes a cylinder 42 which is located adjacent to one of the longitudinal members 22, its axis extending generally in the same direction as that longitudinal members 22. The cylinder 42 has a barrel 44 provided with a port 46 at its cap end, and that end of the cylinder 42 is pivotally connected to a pivot bracket 48 on the adjacent longitudinal member 22. The cylinder 42 also has a piston rod 50 which projects from the opposite end of the barrel 44. The cylinder 42 may be either of the pneumatic or hydraulic variety. If it is hydraulic, the supply of hydraulic fluid may be derived from the hydraulic system for the cylinder which operates the ram 10.

The cylinder 42 moves an actuating lever 52 (FIG. 6) which is located between the two intermediate cross pieces 26 of the frame 20 and pivots about a vertical pin 54 extended between and anchored in those cross pieces 26. Thus, the pin 54 forms the fulcrum for the lever 52. The pivot pin 54 is located farther from the longitudinal member 22 along which the cylinder 44 is extended than from the other longitudinal member 22 and at its one end is connected to the other end of the piston rod 50. Between the pivot pin 54 and the piston rod 50, a turnbuckle 56 is connected with the actuating lever 52, and this turnbuckle 56 is in turn connected with a chain 58 that extends along the side of the air cylinder 42 and wraps around the axle shaft 32 located beyond the cylinder 42. The chain 58 passes over the top of the shaft 32 and then downwardly, and when the piston rod 50 is in its retracted condition, the chain 58 extends in excess of 180° around the shaft 32 (FIG. 2). When the piston rod 50 and chain 58 are so disposed, the spindles 34 on the shaft 32 about which the chain 58 is wrapped are located generally in their uppermost position.

Figure 3:
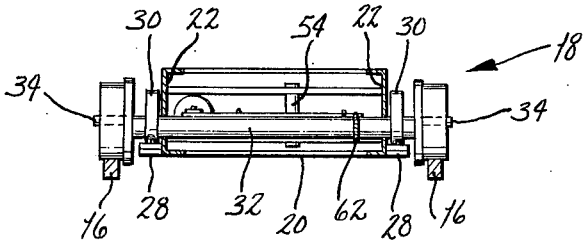
FIG. 3 is a sectional view taken along line 3—3 of FIG. 2 and showing the wheels of the table in their upper non-supporting position.
Figure 4:
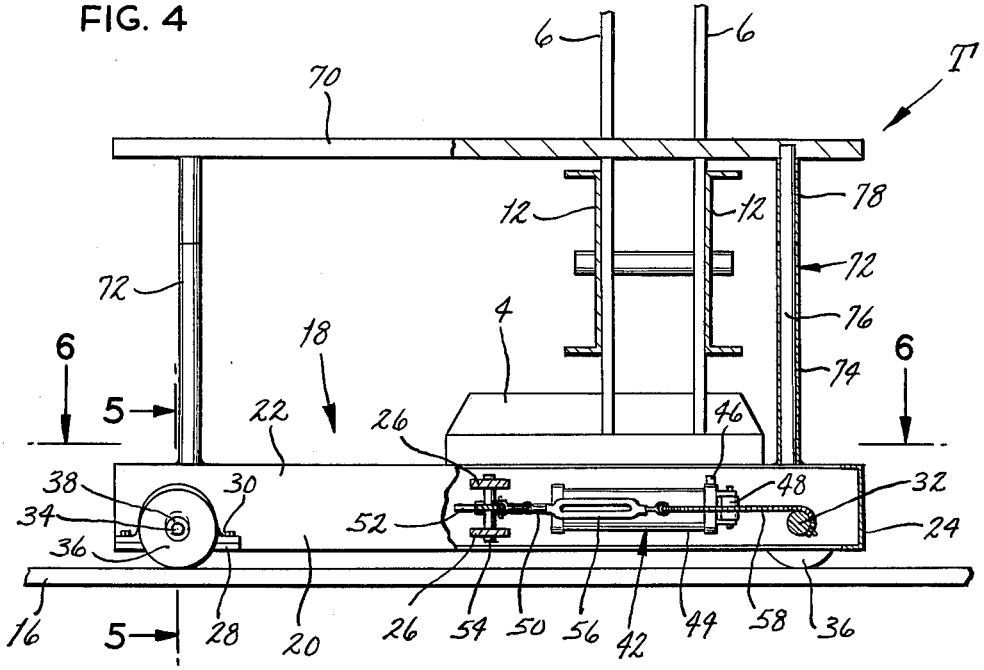
FIG. 4 is a sectional view similar to FIG. 2 but showing the table supported by its wheels and with its table top elevated slightly above the press bed.
Figure 5:
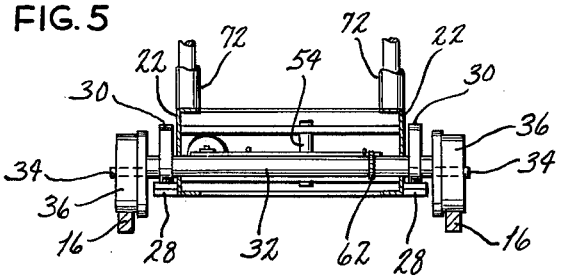
FIG. 5 is a sectional view taken along line 5—5 of FIG. 4 and showing the wheels in their lower supporting position.

The other end of the actuating lever 52 has another turnbuckle 60 (FIG. 6) connected to it, and extended from this turnbuckle along the opposite longitudinal member 22 is another chain 62 which is wrapped around the other axle shaft 32 (FIGS. 3 & 5). Again when the piston rod 50 is retracted the chain 62 is wrapped in excess of 180° around the other axle shaft 32 and the spindles 34 on that shaft are generally in the uppermost positions (FIGS. 2 & 3).

Both turnbuckles 56 and 60 are spaced equally from the pivot pin 54, but are located on opposite sides of the pin 54. The piston rod 50 is connected to the lever 52 at a greater radius from the pin 54 than either of the turnbuckles 56 and 60, and the distance it moves the lever 52 is determined by a stop 64 which is bolted to the longitudinal member 22 along which the cylinder 42 is disposed. The stop 64 includes a bolt 66 against which the lever 52 abuts so that tha bolt 66 actually determines the magnitude of the angle through which the lever 52 rotates. The bolt 66, of course, provides adjustment, and once positioned, it is retained in place by a jam nut 68.

The relationship between the chains 58 and 62 and their respective axle shafts 32 is such that when the cylinder 42 is pressurized so as to rotate the actuating lever 52 about its pin 54, the chains 58 and 62 draw taut and unwind from the shafts 32, rotating the shafts 32 as they do. As a result, the spindles 34 move from the vicinity of their uppermost positions (FIGS. 2 & 3) to the vicinity of their lowermost positions (FIGS. 4 & 5), and the wheels 36 bear firmly against rails of the track 16. This causes the entire carriage 18 to rise slightly to an elevated position in which it is supported entirely on its wheel 36.

In addition to the carriage 18, the table T further includes a flat table top 70 which is disposed over the press bed 12 (FIGS. 1 & 2). It also includes a pair of legs 72 at each end of the table top 70. The legs 72 are attached to the longitudinal members 22 of the carriage 18 with one pair of legs 72 being on one side of the press bed 12 and the other pair being on the other side. Thus, the table top 70 extends over the press bed 12, while the carriage 18 extends beneath it. The length of the table top 70 is considerably greater than the width of the press bed 12. The height of the legs 72 is such that when the spindles 34 on the axle shafts 32 are in their lowermost positions, the table top 70 is elevated slightly above the press bed 12 (FIG. 4). However, when, the spindles 34 are allowed to assume their uppermost positions, the table top 70 will rest on the press bed 12 (FIG. 2).

Each leg 72 which supports the table top 70 includes a lower sleeve 74 which is welded to one of the longitudinal members 22 of the carriage 18. The sleeve 74 extends upwardly from the carriage 18, but not all the way to the underside of the table top P. In addition, the leg 72 includes a rod 76 which has its upper end fitted into and secured to the table top 70. Below the table top 70 the rod projects into the sleeve 74. Indeed, the rod 76 extends all the way to the longitudinal member 22, against which it rests. The rod 76 also extends through a spacer sleeve 78 which is interposed between the upper end of the sleeve 74 and the underside of the table top 70. Since the rod 76 telescopes within the fixed sleeve 74, the leg 72 is extensible and the normal height of the table top 70 above the carriage 18 may be varied by utilizing spacer sleeves 78 of different length.

The port 46 on the barrel 44 of the cylinder 42 is connected with an air line (not shown) which in turn is connected with a source of pressurized fluid; that is, to a source of pressurized air of hydraulic fluid.

OPERATION

Figure 6:
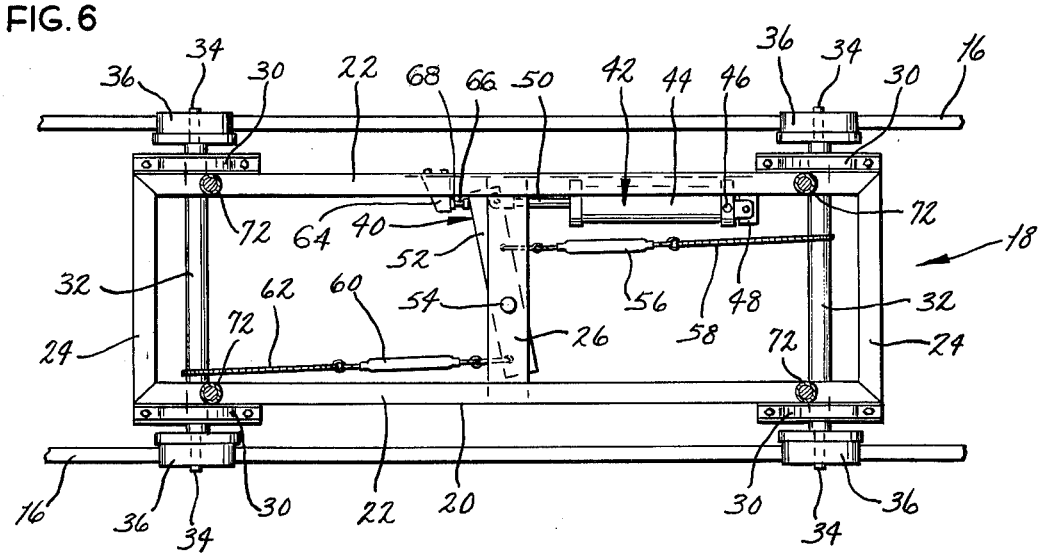
FIG. 6 is a sectional view taken along line 6—6 of FIG. 4 and showing the elevating mechanism for the table carriage.

When the press ram 10 is retracted, the table T is normally in its elevated position (FIG. 4), and in that position it is free to move along the track 16. More specifically, the cylinder 42 is energized by supplying pressurized fluid to its barrel 44. The pressurized fluid causes the piston rod 50 to extend and rotate the actuating lever 52, which in turn draws the chains 58 and 62 taut so that the chains rotate the axial shafts 32 (FIG. 6). The rotation is such that the eccentric spindles 34 of the axles 32 move toward their lowermost positions (FIG. 5), and as a result the flanged wheels 36 bear against the track 16, causing the carriage 18 to assume its elevated position. In that position the table top 70 is located slightly above the press bed 12 (FIG. 4).

When the table T is in its elevated position, it rolls easily on track 16 and may be located such that one side projects substantially further from the press bed 12 than the other side. In that position, one pair of legs 72 is adjacent to the side of the press bed 12. With the table T in the foregoing position, a workpiece is placed upon that portion of the table top 70 which is located to the side of the press bed 12, this being easily accomplished with a simple hoist. The workpiece while suspended by the hoist need not be maniuplated beneath an overhanging structure, but is instead merely lowered directly onto the table top 70.

Once the workpiece is on the table top 70, the hoist is disconnected from it and the entire table T is rolled along the track 16 until the workpiece reaches the desired position beneath the press ram 10. In this position the other pair of legs 72 will most likely be located adjacent to the press bed 12. When the table T is properly located, the barrel 44 of the cylinder 42 is slowly vented, and as a result the entire table T descends under its own weight and the weight of the workpiece supported on it. In particular, the weight is resisted by the wheels 36 at the offset eccentric spindles 34, creating torque at the axle shafts 32 which act as winches and wind the chains 58 and 62 around them. In this connection, when the table T is in its elevated position, the spindles 34 are slightly away from bottom dead center so that the torque is maintained on the shafts and the chains 58 and 62 are under constant tension. The release of the force in the actuating lever 52 causes the lever 52 to pivot about the vertical pivot pin 54 and forces the piston rod 48 back into the barrel 44 so that the air cylinder 42 assumes its retracted position. As all of this takes place, the table top 70 descends until its underside comes against the upper surface of the press bed 12 (FIG. 2).

Once the table top 70 is against the press bed 12, the ram 10 may be energized to apply a force to the workpiece. This force, while being transferred through the table top 70, is nevertheless resisted by the press bed 12 and not by the tracks 16 acting through the wheels 36, the carriage 20, and the legs 72. Hence a rigid support is provided for the workpiece when the ram 10 acts against it.

This invention is intended to cover all changes and modifications of the example of the invention herein chosen for purposes of the disclosure which do not constitute departures from the spirit and scope of the invention.

What is claimed is :

1. A table comprising: a carriage frame; a table top supported by the carriage frame; a pair of parallel axle shafts mounted on the carriage frame and having eccentric spindles at their ends; wheels mounted on the spindles and rotatable relative thereto; and means for rotating the axle shafts in unison so as to lower the wheels relative to the carriage frame and thereby elevate the carriage frame and table top, the means for rotating the axle shafts including chains wrapped around the axle shafts and means remote from the shafts for exerting a force on the chains.

2. A table according to claim 1 wherein the means for exerting a force on the chain comprises an actuating lever pivoted on the carriage frame, and a fluid operated cylinder connected between the lever and the carriage for rotating the lever when energized, the two chains and the fluid cylinder all being connected to the lever remote from the pivot axis of the lever.

3. In combination with a press having a frame on a floor, a bed on the frame, and a ram supported on the frame above the bed and movable toward and away from the bed, a table for supporting a workpiece above the bed and below the ram, said table comprising: a carriage extended below the press bed and having wheels; a table top carried by the carriage and extended over the press bed; and means for moving the wheels between supporting and non-supporting positions, the table top being supported on the press bed when the wheels are in their non-supporting position, the wheels when moved to the supporting position supporting the table independently of the press bed so that the table may be moved relative to the press bed and ram, the means for moving the wheels including an axle having eccentrically disposed spindles at its end with the spindles serving as journals for the wheels, a chain wrapped around the axle, and means for exerting a force on the chain to rotate the axle, whereby the eccentric spindles and the wheels thereon will move upwardly or downwardly.

4. The structure according to claim 3 wherein the means for exerting a force on the chain includes an actuating lever pivoted on the carriage for pivotal movement about a pivot axes, the chain being connected to the lever remote from the pivot axis, and a fluid operated cylinder carried by the carriage and connected to the lever remote from the pivot axis for applying a force to the lever.

5. The structure according to claim 3 and further comprising legs supporting the table top in an elevated position above the carriage, at least one of the legs being on one side of the press bed and another of the legs being on the other side of the press bed.

6. The structure according to claim 5 wherein each leg comprises a sleeve and a rod extends into the sleeve such that the rod is free to telescope into and out of the sleeve, whereby the spacing between the carriage and the table top may be altered.

7. In combination with a press including a rigid frame extended upwardly from a floor, a bed mounted firmly on the frame in an elevated position above the floor, and a ram supported on the frame above the bed and being movable toward and away from the bed, a table for supporting a workpiece such that the ram can exert a force on the workpiece, said table comprising: a carriage frame located beneath the bed; at least one upright supporting member extended upwardly from the carriage frame beyond each side of the press bed, the spacing between the supporting member on one side of the press bed and the supporting member on the other side being greater than the width of the press bed; a table top attached to the supporting members and extended over the press bed, whereby the press bed is located between the table top and the press bed; parallel axles extended across the carriage frame and being mounted thereon such that they are capable of rotating with respect to the frame, the axles having eccentric portions at their ends; wheels mounted on the eccentric portions and being rotatable wih repsect to the eccentric portions; and means on the carriage frame for rotating the axles to cause the eccentric portions to move the wheels thereon between supporting and non-supporting positions, the wheels when in the supporting position causing the table top to be elevated slightly above the press bed so that the table may on its wheels be moved with respect to the press bed, the wheels when in the non-supporting position being higher on the carriage frame than when in the supporting position and enabling the table top to rest on the press bed so that a force applied by the ram to a workpiece on the table top will be resisted by the press bed.

8. The structure according to claim 7 wherein the wheels ride on a track which is on the floor on which the press frame is supported.

9. The structure according to claim 7 wherein the wheels move downwardly to their supporting position and upwardly to their non-supporting position.

10. The structure according to claim 9 wherein the supporting members are freely extensible.

* * * * *